US008050580B2

(12) United States Patent
Kikuchi

(10) Patent No.: US 8,050,580 B2
(45) Date of Patent: Nov. 1, 2011

(54) CONTINUOUS-SHEET PRINTING TANDEM ELECTROPHOTOGRAPHY SYSTEM AND METHOD OF PRINTING A CONTINUOUS SHEET

(75) Inventor: Toru Kikuchi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 12/542,939

(22) Filed: Aug. 18, 2009

(65) Prior Publication Data

US 2010/0054772 A1 Mar. 4, 2010

(30) Foreign Application Priority Data

Aug. 26, 2008 (JP) ..... 2008-216645

(51) Int. Cl.
*G03G 15/00* (2006.01)
*B41J 2/435* (2006.01)
*B41J 2/47* (2006.01)

(52) U.S. Cl. ..... 399/45; 399/384; 347/237; 347/247; 347/248

(58) Field of Classification Search ..... 399/38, 399/45, 306, 320, 384, 389, 401; 347/132, 347/133, 156, 237, 247, 248, 249; 430/124.1, 430/124.23, 124.3
See application file for complete search history.

(56) References Cited

U.S. PATENT DOCUMENTS

| | | | | |
|---|---|---|---|---|
| 5,285,247 | A * | 2/1994 | Itoh | 347/237 X |
| 5,995,130 | A | 11/1999 | Akatsu et al. | |
| 6,650,864 | B2 * | 11/2003 | Miyamoto et al. | 399/384 |
| 6,667,756 | B2 * | 12/2003 | Conrow et al. | 347/248 |
| 6,714,758 | B2 * | 3/2004 | Miyamoto et al. | 399/384 |
| 6,795,683 | B2 * | 9/2004 | Nakazawa et al. | 399/384 |
| 7,062,217 | B2 * | 6/2006 | Tsukamoto et al. | 399/401 |
| 7,170,543 | B2 * | 1/2007 | Yamada et al. | 347/237 |
| 7,280,131 | B2 * | 10/2007 | Yamada et al. | 347/247 |

FOREIGN PATENT DOCUMENTS

| | | |
|---|---|---|
| JP | 2004-271739 | 9/2004 |
| JP | 2004-347842 | 12/2004 |
| JP | 2005-186614 | 7/2005 |
| JP | 2009-69545 | 4/2009 |

* cited by examiner

*Primary Examiner* — Sandra Brase
(74) *Attorney, Agent, or Firm* — Oblon, Spivak, McClelland, Maier & Neustadt, L.L.P.

(57) ABSTRACT

A continuous-sheet printing tandem electrophotography system for printing a continuous sheet includes first and second electrophotography units. A first size of the continuous sheet is measured before an image printed by the first electrophotography unit with a first parameter value is fused on the continuous sheet. A second size of the continuous sheet is measured after the image printed by the first electrophotography unit is fused on the continuous sheet. The second electrophotography unit then prints the continuous sheet with a second parameter value that is determined by a size difference between the first and the second sizes. The first and the second sizes include a page length and a page width of the continuous sheet. The parameter values include a print speed, a polygon mirror rotating speed, a video clock frequency, and a laser power.

13 Claims, 6 Drawing Sheets

401 402

| | UPSTREAM UNIT | DOWNSTREAM UNIT |
|---|---|---|
| PRINT SPEED | V | (L'/L) × V |
| MIRROR ROTATION SPEED | R | (L'/L) × R |
| VIDEO CLOCK FREQUENCY | F | (L'/L) × (W/W') × F |
| LASER POWER | P | (L'/L) × (W'/W) × P |

FIG.5

401 402

| | UPSTREAM UNIT | DOWNSTREAM UNIT |
|---|---|---|
| PRINT SPEED | V | (L'/L) × V |
| MIRROR ROTATION SPEED | R | (L'/L) × R |
| VIDEO CLOCK FREQUENCY | F | (L'/L) × (W/W') × F |
| LASER POWER | P | (L'/L) × (W'/W) × P |

CONTINUOUS-SHEET PRINTING TANDEM ELECTROPHOTOGRAPHY SYSTEM AND METHOD OF PRINTING A CONTINUOUS SHEET

BACKGROUND OF THE INVENTION

1. Field of the Invention

The present invention relates to a continuous-sheet printing tandem electrophotography system having a plurality of electrophotography apparatuses coupled to one another for printing a continuous sheet of a recording medium, and a method of printing a continuous sheet. In particular, the present invention relates to the correction of a print position error between the both sides of a printed continuous sheet.

2. Description of the Related Art

FIG. 1 schematically illustrates the principle of operation of a conventional electrophotography apparatus. A laser light source 301 is turned on or off in accordance with image data transmitted in synchronization with a video clock. The laser light source 301 emits a laser beam 302 that is reflected by a polygon mirror 303 as it rotates at a certain angular velocity, thereby scanning the surface of a photosensitive drum 304 rotating at a predetermined velocity with the laser beam 302. As a result, a latent image is formed on the surface of the photosensitive drum 304.

A beam detector 305 is disposed along the scanning line of the laser beam 302. Upon detection of the laser beam 302, the beam detector 305 outputs a horizontal synchronization signal, in accordance with which the output timing of the image data is determined so that an accurate write start position can be obtained.

The latent image on the photosensitive drum 304 is then developed using a magnetic brush of a two-component developer consisting of a mixture of a toner 306 and a carrier at a certain ratio. Specifically, the toner 306 is caused to attach to the surface of the photosensitive drum 304, thereby making the latent image visible as a toner image.

A continuous sheet 308 is transported by tractors or rollers 307 at a speed corresponding to the circumferential speed of the photosensitive drum 304, and the toner image on the photosensitive drum 304 is transferred onto the continuous sheet 308 by a transfer unit 309. The toner image on the continuous sheet 308 is then fused thereon by pressing and heating by a fusing unit including rollers 310, thus completing the print process.

In this case, it is necessary to synchronize the rotating speed of the polygon mirror 303 as it reflects the laser beam, the rotating speed of the photosensitive drum 304, and the sheet transport speed. For this purpose, a single oscillator is generally used. Specifically, the individual devices are driven in accordance with a control clock, so that their relative synchronization can be ensured as long as the control clock is generated by the same oscillator. If the devices are controlled by different oscillators, the difference in the clock signals accumulates in the continuous-sheet electrophotography apparatus and the devices lose synchronization, rendering the realization of normal apparatus performance impossible.

The frequency of the control clock is uniquely determined by the optical specifications of the apparatus, a sheet transport speed which is equivalent to the print speed, and the photosensitive drum rotation speed. Another condition is that there should be only one oscillator, as mentioned above. Thus, the oscillating frequency is calculated from the least common multiple of the clock frequencies required by the individual devices, and an appropriate crystal oscillator is selected from the viewpoint of accuracy.

A continuous-sheet printing tandem electrophotography system is known in which a couple of continuous-sheet electrophotography apparatuses of the aforementioned type are disposed upstream and downstream along the transport of a continuous sheet, for printing both sides of the sheet, for example. Such a system has a market under the category of electrophotography equipment as a relatively simple commercial printing machine capable of high-speed, high-availability, and low-cost operations. Although there are also special-purpose offset printing machines, such as rotary presses, these are designed to compensate for the time-consuming setup process with the number of printed pages and are therefore not suitable for low-volume production. Thus, a small-volume, small-lot commercial printer market is being developed in which electrophotography systems and offset printing machines are competing against each other.

There has recently been a growing demand for coupling a plurality of continuous sheet electrophotography apparatuses for printing. FIG. 2 schematically shows a continuous-sheet printing tandem electrophotography system. In this system, two continuous-sheet electrophotography apparatuses of the type shown in FIG. 1 may be coupled and used in various combinations. For example, an upstream device 401 to the right in FIG. 2 prints an upper surface of a continuous sheet, followed by the printing of a lower surface by a downstream device 402 to the left, thus forming a double-side printing system. Alternatively, the upstream device 401 may use black toner while the downstream device 402 may use a color toner, thereby forming a spot color printing system. In the illustrated example, a sheet inverting unit 403 is provided between the upstream device 401 and the downstream device 402, forming a double-side printing system.

One drawback of this system is that when a double-side printing is performed, thermal contraction of the sheet occurs in the fusing unit of the upstream device 401, so that a print position error is caused when the lower surface is printed by the downstream device 402. Solution of the problem is earnestly desired because the above system enables the small-volume, small-lot production of printed matter for commercial printing purposes by a simple operation.

Various methods for correcting the contraction of the sheet have been proposed, such as Japanese Laid-Open Patent Application Nos. 2004-347842 and 2005-186614 teaching controlling the operating frequency of a laser clock, the speed of a polygon mirror motor, or the PWM output of laser power. However, these methods are all directed to electrophotography apparatuses using cut-sheets, where the upper and lower surfaces of a cut-sheet are printed in a single printing system along separate time axes by switching control values and by inverting the cut-sheet. Although the time for transition between the control values is ensured during the time of no printing between pages, the conventional methods do not take into consideration the decrease in throughput, which is a serious concern from the viewpoint of commercial printing. Further, the aforementioned related art does not provide any quantitative definition concerning main and sub scan operations and laser power correction.

In a continuous-sheet tandem printing system using a continuous sheet, the operation of one printing unit may need to be temporarily stopped when the individual printing units are allocated different numbers of pages to process, thus resulting in a decrease in throughput. If a sheet stays between the upper- and lower-surface print units, problems other than a print quality problem may be caused. Therefore, it is necessary for the upper- and lower-surface print units to process the same number of pages along the same time axis, and to achieve print position alignment between the lower and upper surfaces when a sheet contraction develops.

SUMMARY OF THE INVENTION

It is a general object of the present invention to provide a continuous-sheet printing tandem electrophotography system and a method of printing a continuous sheet by which one or more of the aforementioned problems of the related art are eliminated.

A more specific object of the present invention is to provide a continuous-sheet printing tandem electrophotography system by which a high-quality printed output having no print position error can be obtained.

According to one aspect of the present invention, a continuous-sheet printing tandem electrophotography system for printing a continuous sheet includes a first electrophotography unit disposed upstream of a direction of transport of the continuous sheet and configured to print a first image on the continuous sheet with a first parameter value; a second electrophotography unit disposed downstream of the direction of transport of the continuous sheet and configured to print a second image on the continuous sheet with a second parameter value; a size measuring unit configured to measure a first size of the continuous sheet before the first image is printed on the continuous sheet by the first electrophotography unit, and configured to measure a second size of the continuous sheet after the first image is printed on the continuous sheet by the first electrophotography unit; a control unit configured to compare the first size and the second size of the continuous sheet in order to obtain a difference value indicating a size difference between the first and the second sizes. The second parameter value is determined by the difference value obtained by the control unit.

According to another aspect of the present invention, a method of printing a continuous sheet by an electrophotographic process includes the steps of measuring a first size of the continuous sheet before the continuous sheet is printed; printing a first image on the continuous sheet with a first parameter value; measuring a second size of the continuous sheet after the first image is printed on the continuous sheet; comparing the first size and the second size of the continuous sheet in order to obtain a value indicating a size difference between the first and the second sizes; and printing a second image on the continuous sheet after the first image is printed thereon, with a second parameter value that is determined by the size difference between the first and the second sizes of the continuous sheet.

BRIEF DESCRIPTION OF THE DRAWINGS

Other objects, features and advantages of the present invention will become apparent upon consideration of the specification and the appendant drawings, in which:

FIG. 5 shows a table indicating the relationships between an upstream device and a downstream device in terms of print speed, the rotating speed of the polygon mirror, video clock frequency, and laser power.

DETAILED DESCRIPTION OF THE PREFERRED EMBODIMENTS

Figure 1:
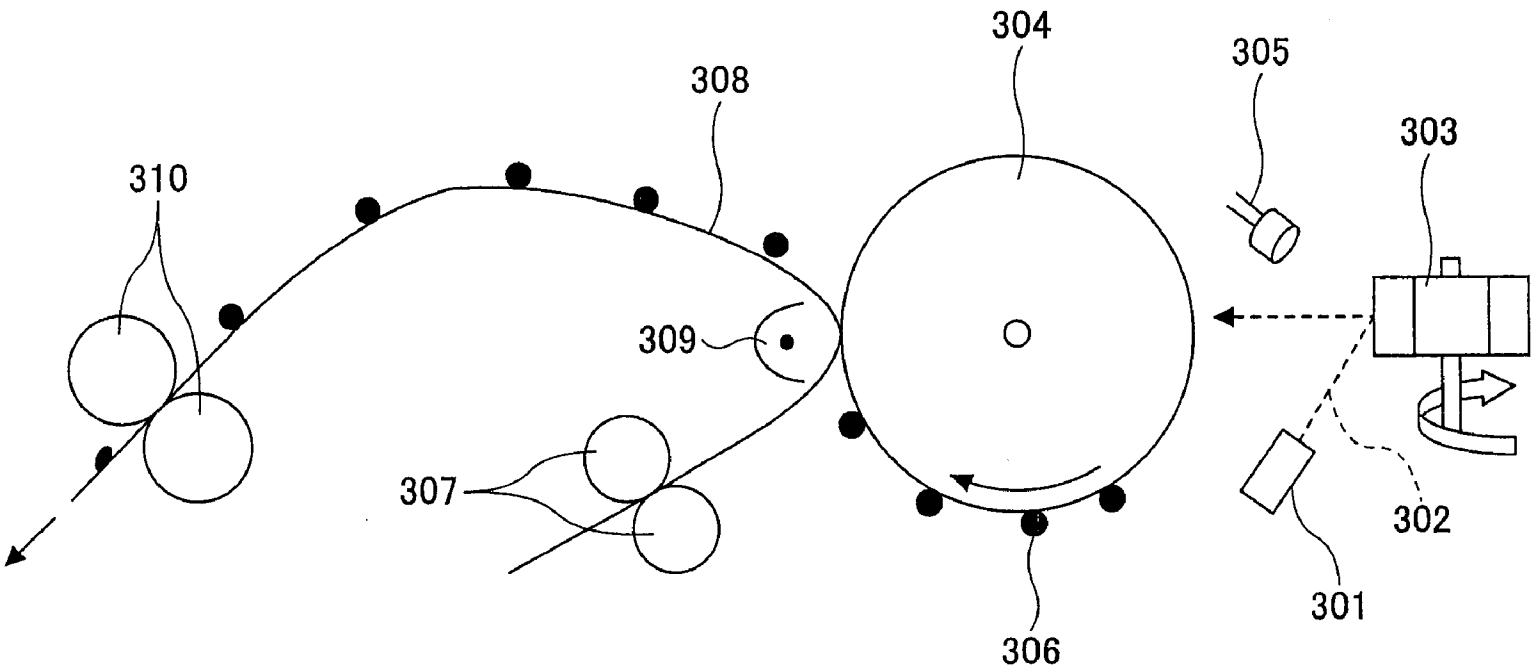
FIG.1 Related Art
FIG. 1 schematically shows an electrophotography apparatus according to the related art.
Figure 2:
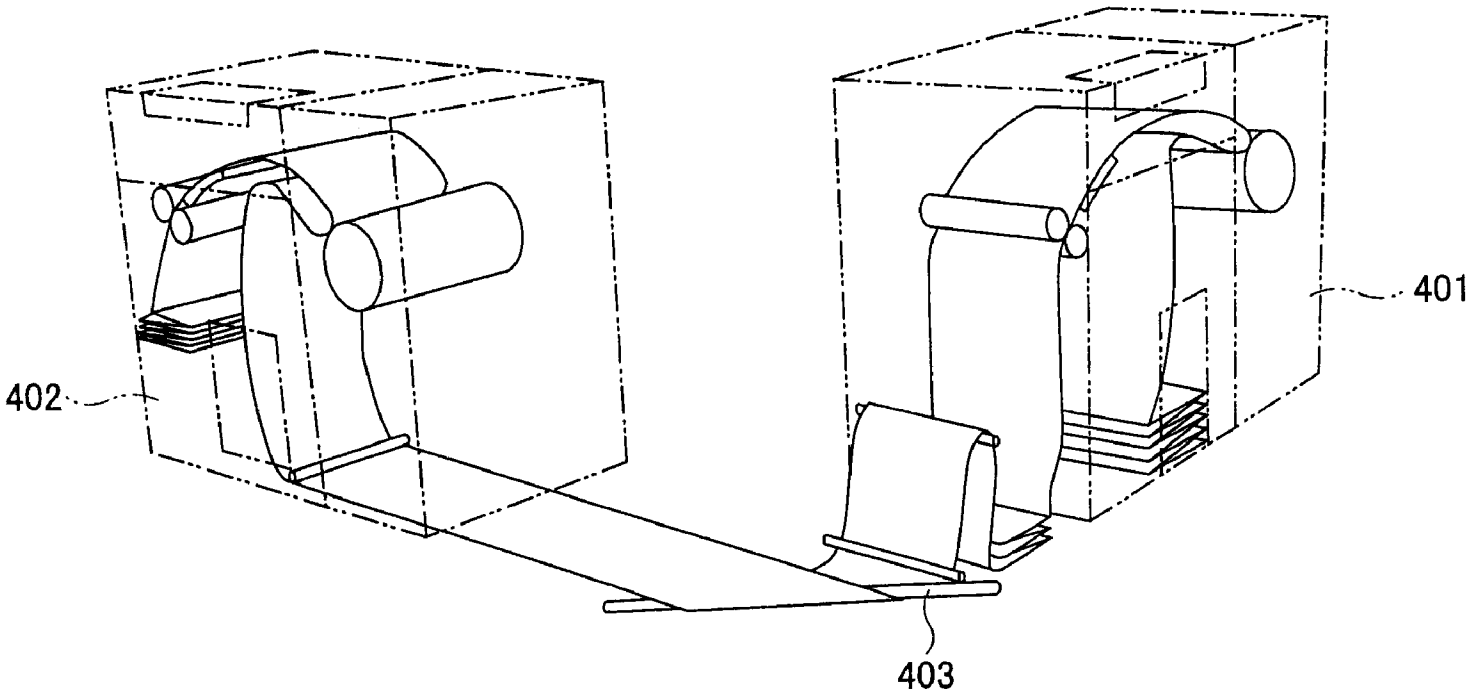
FIG.2 Related Art
FIG. 2 shows a continuous-sheet printing tandem electrophotography system according to the related art.
Figure 3:
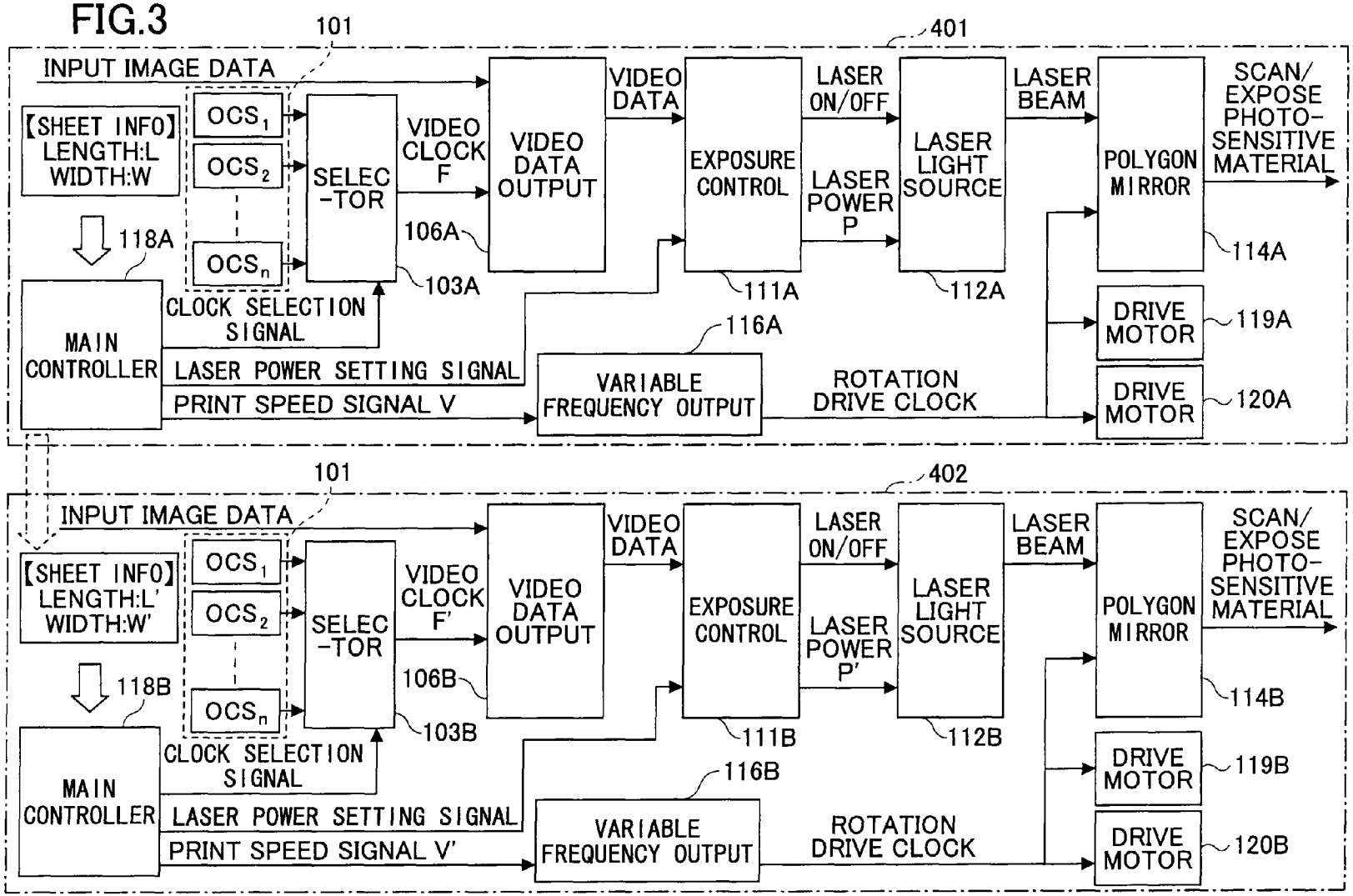
FIG. 3 shows a block diagram of a continuous-sheet printing tandem electrophotography system according to an embodiment of the present invention.

Referring now to the drawings, wherein like reference numerals designate identical or corresponding parts throughout the several views, embodiments of the present invention are described. FIG. 3 shows a block diagram of a continuous-sheet printing tandem electrophotography system including an upstream device 401 and a downstream device 402 according to an embodiment of the present embodiment. In this system, both sides of a continuous sheet are printed, as in the case of FIG. 2.

In FIG. 3, the designation of each of the units of the upstream device 401 and the downstream device 402 is suffixed with "A" or "B", indicating that it belongs to the upstream device 401(A) or the downstream device 402(B). The suffixes "A" and "B", however, are omitted in the following description of the embodiments whenever appropriate.

As shown in FIG. 3, each of the upstream device 401 and the downstream device 402 includes a main control unit 118, an oscillator 101, a selector 103, a image data output unit 106, an exposure control unit 111, a laser light source 112, a polygon mirror 114, a drive motor 119 for rotating a photosensitive drum (not shown in FIG. 3), and a drive motor 120 for rotating rollers of a sheet transport unit (not shown in FIG. 3).

The oscillator 101 includes plural oscillators $\mathbf{101}_1$ to $\mathbf{101}_n$ generating different frequencies. The selector 103 selects one of the oscillators $\mathbf{101}_1$ to $\mathbf{101}_n$ in accordance with a clock select signal from the main control unit 118, and outputs a video clock F (F').

Input image data is fed to the image data output unit 106, which processes the image data into image data that is outputted to the exposure control unit 111 in synchronism with the video clock F (F'). The main control unit 118 also outputs a laser power setting signal to the exposure control unit 111.

The exposure control unit 111, to which the image data and the laser power setting signal are fed, then outputs a laser on/off signal and a laser power signal P(P') to a laser light source 112.

In accordance with the input laser on/off signal, the laser light source 112 controls the emission of a laser beam. When the laser light source 112 emits the laser beam, the laser power is controlled in accordance with the laser power signal P(P'). The laser beam emitted by the laser light source 112 is reflected by the polygon mirror 114 rotating at a certain angular velocity, thus scanning the surface of the photosensitive drum with the laser beam. The angular velocity of the polygon mirror 114 is determined by a rotation drive clock that is outputted by a variable frequency output unit 116. The rotation drive clock is switched by a print speed signal V(V') from the main control unit 118.

The rotation drive clock is also fed to the drive motor 119 for driving the photosensitive drum and to the drive motor 120 for driving the sheet transport rollers. Thus, the rotation speed of the photosensitive drum and the sheet transport speed, i.e., print speed, are controlled by the rotation drive clock.

A latent image formed on the surface of the photosensitive drum by exposure to the laser beam is developed and then transferred onto a sheet (not shown in FIG. 3) as a toner image. The toner image is then fused onto the sheet by the application of heat and pressure by a fusing unit (not shown in FIG. 3).

Figure 4:
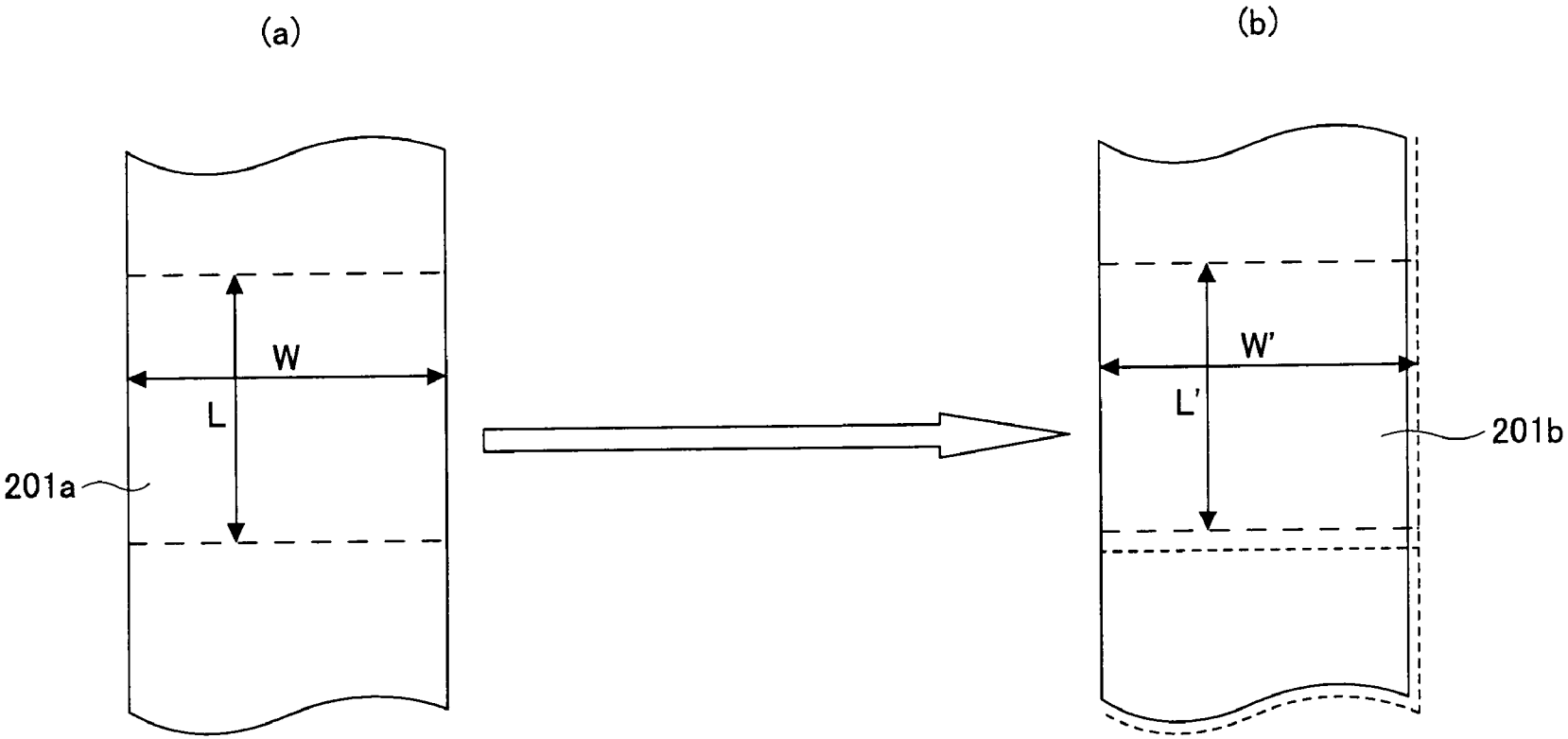
FIGS. 4(*a*) and 4(*b*) illustrate a contraction of a sheet after a fusing process in an upstream device of the system shown in FIG. 3.

With reference to FIG. 4, contraction of the sheet due to the application of heat by the fusing unit is described, by referring to the upstream device 401 of the continuous-sheet printing tandem electrophotography system.

FIG. 4(*a*) shows a sheet 201*a* before fusing in the upstream device 401 for upper surface print. The sheet 201*a* has a nominal page length L and a nominal page width W. FIG. 4(*b*) shows a sheet 201*b* that has been fused by the fusing unit of the upstream device 401. The sheet 201*b* has a page length L' and a page width W', indicating a print position error due to thermal contraction.

With reference to FIG. 5, a method of correcting the print position error in the contracted sheet by adjusting the print speed, the rotating speed of the mirror, the video clock frequency, and the laser power in the downstream device is described. FIG. 5 shows a table indicating the relationships between the upstream and downstream devices in terms of the aforementioned parameters.

For example, the upstream device 401 has a print speed V and a page length L, and the downstream device 402 has a print speed V' and a page length L'. Because a condition "L/V=L'/V'=constant" must be satisfied in order for the upstream and downstream devices to have the same page print time, the print speed of the downstream device 402 is V'=(L'/L)×V.

The page length L may be measured by printing a mark at the head of each page and then optically measuring the mark intervals after the transfer step in the upstream device 401, using a reflective optical sensor. After the sheet has passed through the fusing unit of the upstream device 401, the mark intervals may be measured again in the downstream device 402 before the transfer step, thus determining the page length L'.

If the rotating speed (angular velocity) of the polygon mirror is changed from R to R' by changing the print speed from V to V', the number of scans, i.e., the rotating speed of the mirror, per unit print speed is constant. Because R/V=R'/V'=constant, when the rotating speed of the polygon mirror of the upstream device 401 is R, the rotating speed of the polygon mirror of the downstream device 402 is R'=(V'/V)×R=(L'/L)×R.

The video clock frequency F' is related to the correction for the change in the rotating speed (angular velocity) of the polygon mirror, and to the correction for the contraction of the sheet in its width direction. When print speed is changed from V to V', the rotating speed of the mirror is changed from R to R'. When video clock time T=1/F, and the number of items of image data per scan is n, where the distance per scan is constant, F'=1/T'=(R'/R)×F=(L'/L)×F since R×T×n=R'×T'×n=constant.

On the assumption that the distance per scan should be corrected from W to W' by the video clock frequency when the sheet width has changed from W to W', the frequency is switched to F'=(W/W')×F because W/(T×n)=W'/(T'×n)=constant. Thus, a correction is made so that F'=(L'/L)×(W/W')×F. When the ratio of change in sheet width (W'/W) is equal to the ratio of change in sheet length (L'/L), F'=F; namely, the video clock frequency F' of the downstream device 402 is the same as the video clock frequency F of the upstream device 401, and therefore no correction is required.

As to the laser power P', when the energy per unit scan is constant, since P/(R×T×n)=P'/(R'×T'×n)=constant, P'=(P×R')/(R×T')/T=(L'/L)×(W'/W)×P.

For measuring the sheet widths W and W', marks may be printed at the side edges of the sheet in its width direction (perpendicular to the sheet transport direction), and then the mark intervals may be optically measured after the transfer step in the upstream device 401 to determine the sheet width W. Thereafter, after the sheet has passed the fusing unit of the upstream device 401, the mark intervals may be optically measured in the downstream device 402 prior to the transfer step in order to determine the sheet width W'.

Thus, referring to FIG. 5, when the upstream device 401 has print speed V, the print speed of the downstream device 402 is set so that V'=(L'/L)×V. When the rotating speed of the polygon mirror in the upstream device 401 is R, the rotating speed of the polygon mirror in the downstream device 402 is set so that R'=(V'/V)×R=(L'/L)×R. When the video clock frequency of the upstream device 401 is F, the video clock frequency of the downstream device 402 is set so that F'=(L'/L)×(W/W')×F. When the upstream device 401 has a laser power P, the laser power of the downstream device 402 is set so that P'=(L'/L)×(W'/W)×P.

The aforementioned print speed may be set by adjusting the control clock supplied to the drive motor 119 for the photosensitive drum and the drive motor 120 for the sheet transport unit. The rotating speed of the polygon mirror 114 may be set by adjusting the control clock for the corresponding drive motor (not shown). The video clock frequency may be adjusted by selecting the oscillator 101 appropriately. The laser power may be adjusted by adjusting the current supplied to the laser light source 112.

Figure 6:
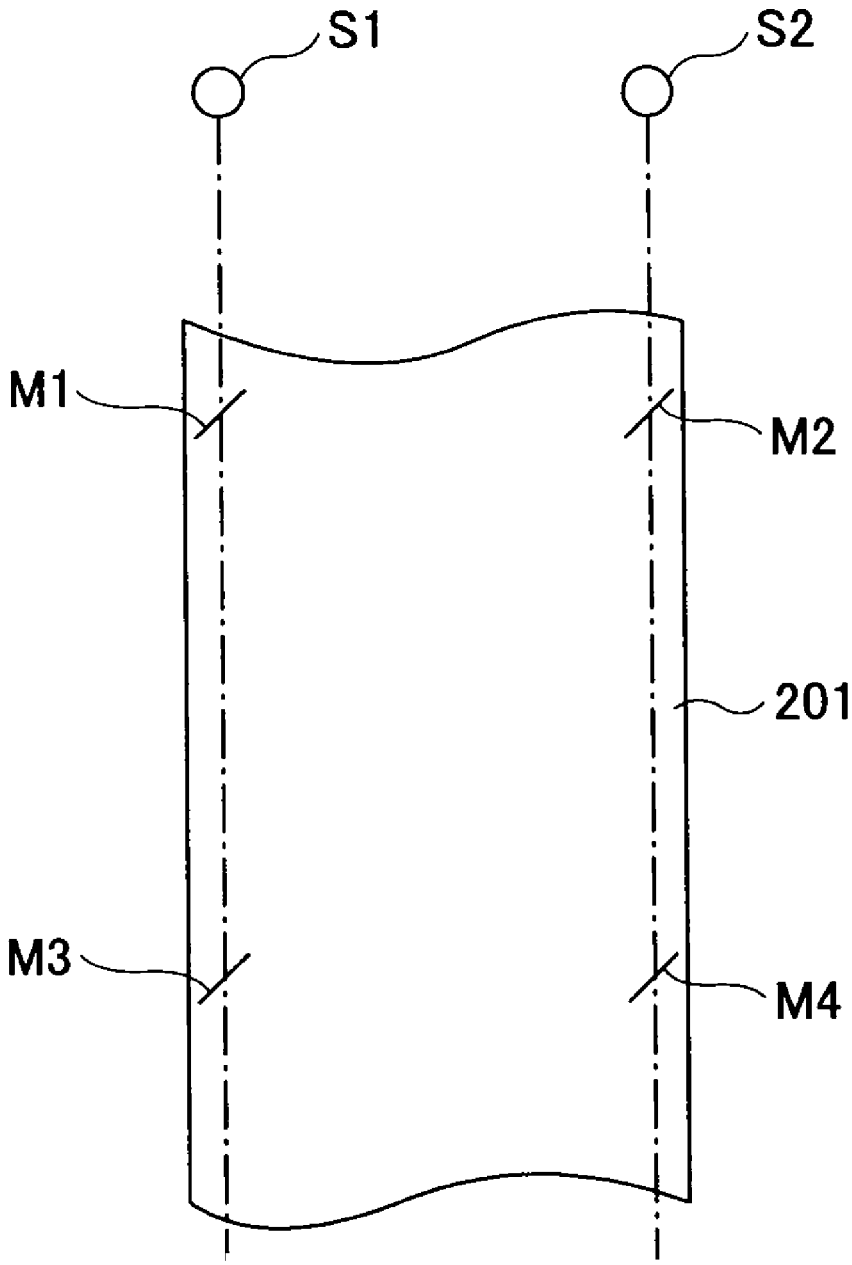
FIG. 6 shows an arrangement of sensors relative to a printed sheet according to an embodiment of the present invention for measuring a page length and a sheet width of the sheet simultaneously.

With reference to FIG. 6, a method of measuring the page length L(L') and the sheet width W(W') of the sheet 201 simultaneously is described. As shown in FIG. 6, marks M1 and M2 are printed at a front edge of the page of the sheet 201, one on either side in the width direction. Marks M3 and M4 are also printed at the front edge of the next page, one on either side in the width direction. While in accordance with the present embodiment these marks M1 to M4 are lines inclined at an angle (45°) with respect to the transport direction of the sheet 201, they may be triangular in shape in another embodiment.

On a line extending through the marks M1 and M3, a reflective optical sensor S1 is disposed. A reflective optical sensor S2 is disposed on a line extending through the marks M2 and M4. In the upstream device 401, the optical sensors S1 and S2 are disposed upstream of the fusing device in the sheet transport direction. In the downstream device 402, similar optical sensors S1 and S2 are disposed upstream of the fusing device in the sheet transport direction. Based on the timing of detection of the interval between the marks M1 and M3 (M2 and M4), and the interval between the marks M1 and M2 (M3 and M4) with the optical sensors S1 and S2 in the upstream and downstream devices 401 and 402, the page length L(L') and the sheet width W(W') of the sheet 201 are simultaneously measured.

Detection signals (sheet information) from the optical sensors S1 and S2 in the upstream device 401 are fed to the main control unit 118A of the upstream device 401 and the main control unit 118B of the downstream device 402. Detection signals (sheet information) from the optical sensors S1 and S2 in the downstream device 402 are supplied to the main control unit 118B of the downstream device 402.

In accordance with the present embodiment, both sides of a continuous sheet are printed by the upstream device 401 and the downstream device 402. However, the present invention is not limited to such an embodiment. In another embodiment, the upstream device may print with a black toner and the downstream device may print with a color toner in a spot color print system.

The sensors for measuring the page length L' and the page width W' of the continuous sheet may be disposed at any location between the downstream of the fusing unit of the upstream device 401 and the upstream of the fusing unit of the downstream device 402.

In accordance with another embodiment of the present invention, processing of a lower surface of a sheet medium may be adjusted depending on any change in the shape of the sheet that may be caused by the processing of an upper surface of the sheet medium.

Although this invention has been described in detail with reference to certain embodiments, variations and modifications exist within the scope and spirit of the invention as described and defined in the following claims.

The present application is based on the Japanese Priority Application No. 2008-216645 filed Aug. 26, 2008, the entire contents of which are hereby incorporated by reference.

What is claimed is:

1. A continuous-sheet printing tandem electrophotography system for printing a continuous sheet, the system comprising:

a first electrophotography unit disposed upstream of a direction of transport of the continuous sheet and configured to print a first image on the continuous sheet with a first parameter value;

a second electrophotography unit disposed downstream of the direction of transport of the continuous sheet and configured to print a second image on the continuous sheet with a second parameter value;

a size measuring unit configured to measure a first size of the continuous sheet before the first image is printed on the continuous sheet by the first electrophotography unit, and configured to measure a second size of the continuous sheet after the first image is printed on the continuous sheet by the first electrophotography unit;

a control unit configured to compare the first size and the second size of the continuous sheet in order to obtain a difference value indicating a size difference between the first and second sizes, wherein the second parameter value is determined by the difference value obtained by the control unit, each of the first and the second electrophotography units include, a light source configured to emit a light beam, a photosensitive member configured to be rotated at a photosensitive member rotating speed, a scanning unit configured to scan the photosensitive member with the light beam emitted by the light source having a certain beam power, in accordance with image data corresponding to the first or the second image, in order to form a latent image corresponding to the image data on the photosensitive member, a developing unit configured to develop the latent image on the photosensitive member into a visible image, a sheet transport unit configured to transport the continuous sheet in the direction of transport of the continuous sheet at a sheet transport speed, an image transferring unit configured to transfer the visible image on the photosensitive member onto the continuous sheet transported by the sheet transport unit, a fusing unit configured to fuse the visible image on the continuous sheet an oscillator configured to generate different frequencies, a selector configured to select one of the frequencies generated by the oscillator as a video clock in accordance with a clock select signal supplied from the control unit, a video data output unit configured to output video data at the frequency of the selected video clock based on the image data, an exposure control unit configured to output a beam on/off signal based on the video data and configured to output a beam power signal based on a beam power setting signal supplied from the control unit, a mirror configured to reflect the light beam emitted by the light source while the mirror rotates at a mirror rotating speed, and a variable frequency output unit configured to output a rotation drive clock of a certain frequency to the mirror, the photosensitive member, and the sheet transport unit, the frequency of the rotation drive clock being adjusted in accordance with a print speed signal indicating a print speed that is supplied from the control unit, and the sheet transport speed, the photosensitive member rotating speed, and the mirror rotating speed are determined by the rotation drive clock, each of the first and the second sizes of the continuous sheet include a page length and a page width of the continuous sheet, and the light source emits the light beam in accordance with the beam on/off signal from the exposure control unit while the beam power of the light beam is controlled in accordance with the beam power signal from the exposure control unit, the control unit controls the clock select signal, the beam power setting signal, and the print speed signal in the first electrophotography unit so that the first image is printed on the continuous sheet having a page length L and a page width W by the first electrophotography unit with the first parameter value including a print speed V, a mirror rotating speed R, a video clock frequency F, and a light beam power P, the control unit controls the second electrophotography unit so that the second image is printed on the continuous sheet having a page length L' and a page width W', after passing the fusing unit of the first electrophotography unit, by the second electrophotography unit with the second parameter value including a print speed V', a mirror rotating speed R', a video clock frequency F', and a light beam power P', and the following expressions are satisfied $$V'=(L'/L)\times V,$$

$$R'=(L'/L)\times R,$$

$$F'=(L'/L)\times(W/W')\times F, \text{ and}$$

$$P'=(L'/L)\times(W'/W)\times P.$$

2. The continuous sheet printing tandem electrophotography system according to claim 1, wherein the light source emits a laser light beam.

3. The continuous-sheet printing tandem electrophotography system according to claim 1, wherein the developing unit develops the latent image by causing a toner to attach to the photosensitive member.

4. The continuous-sheet printing tandem electrophotography system according to claim 1, wherein the fusing unit fuses the visible image onto the continuous sheet by applying heat or pressure against the continuous sheet.

5. The continuous-sheet printing tandem electrophotography system according to claim 1, wherein the mirror includes a polygon mirror.

6. The continuous-sheet printing tandem electrophotography system according to claim 1, wherein the size measuring unit includes:

a first sensor disposed upstream of the fusing unit of the first electrophotography unit and configured to measure the position of a mark provided at a front edge portion of each page of the continuous sheet in order to measure the page length L and the page width W; and a second sensor disposed downstream of the fusing unit of the first electrophotography unit and configured to measure the position of the mark in order to measure the page length L' and the page width W'.

7. The continuous-sheet printing tandem electrophotography system according to claim 1, wherein a first side of the continuous sheet is printed by the first electrophotography unit and a second side of the continuous sheet is printed by the second electrophotography unit.

8. A method of printing a continuous sheet by an electrophotographic process, the method comprising:

measuring a first size of the continuous sheet before the continuous sheet is printed;

printing a first image on the continuous sheet with a first parameter value;

measuring a second size of the continuous sheet after the first image is printed on the continuous sheet;

comparing the first size and the second size of the continuous sheet in order to obtain a value indicating a size difference between the first and second sizes; and printing a second image on the continuous sheet after the first image is printed thereon, with a second parameter value determined by the value indicating a size difference between the first and second sizes wherein each of the printing the first and the second images on the continuous sheet include emitting a light beam from a light source, scanning a photosensitive member rotating at a photosensitive member rotating speed with the light beam having a certain beam power in accordance with image data corresponding to the first or the second image, thereby forming a latent image corresponding to the image data on the photosensitive member, developing the latent image on the photosensitive member into a visible image, transporting the continuous sheet at a sheet transport speed, transferring the visible image onto the continuous sheet being transported at the sheet transport speed, fusing the visible image on the continuous sheet, generating different frequencies, selecting one of the frequencies as a video clock in accordance with a clock select signal, producing video data from the image data having the frequency of the selected video clock, producing a beam on/off signal based on the video data, producing a beam power signal based on a beam power setting signal, reflecting the light beam emitted by the light source with a mirror rotating at a mirror rotating speed, generating a rotation drive clock of a certain frequency that determines the mirror rotating speed, the photosensitive member rotating speed, and the sheet transport speed, and adjusting the frequency of the rotation drive clock in accordance with a print speed signal indicating a print speed, and the printing the first image further includes printing the first image on the continuous sheet having a page length L and a page width W with the first parameter value including a print speed V, a mirror rotating speed R, a video clock frequency F, and a laser power P, and the printing the second image further includes printing the second image on the continuous sheet having a page length L' and a page width W' with the second parameter value including a print speed V', a mirror rotating speed R', a video clock frequency F', and a laser power P', and the method further comprises controlling the clock select signal, the beam power setting signal, and the print speed signal so that the following expressions are satisfied $$V'=(L'/L)\times V,$$

$$R'=(L'/L)\times R,$$

$$F'=(L'/L)\times(W/W')\times F, \text{ and}$$

$$P'=(L'/L)\times(W'/W)\times P.$$

9. The method according to claim 8, wherein the step of emitting the light beam includes emitting a laser light beam.

10. The method according to claim 8, wherein the step of developing the latent image includes causing a toner to attach to the photosensitive member.

11. The method according to claim 8, wherein the step of fusing the visible image onto the continuous sheet includes applying heat or pressure against the continuous sheet.

12. The method according to claim 8, wherein the steps of measuring the first and the second size include:

providing a mark at a front edge portion of a page of the continuous sheet;

measuring a first position of the mark before the first image is fused on the continuous sheet in order to measure the page length L and the page width W; and measuring a second position of the mark after the first image is fused on the continuous sheet in order to measure the page length L' and the page width W'.

13. The method according to claim 8, wherein the first image is printed on a first side of the continuous sheet and the second image is printed on a second side of the continuous sheet.

* * * * *